US010378782B2

(12) United States Patent
Kamiaka et al.

(10) Patent No.: US 10,378,782 B2
(45) Date of Patent: Aug. 13, 2019

(54) OUTDOOR UNIT

(71) Applicant: Hitachi-Johnson Controls Air Conditioning, Inc., Tokyo (JP)

(72) Inventors: Takumi Kamiaka, Tokyo (JP); Masayoshi Murofushi, Tokyo (JP); Atsuhiko Fukasawa, Tokyo (JP); Shuntaro Inoue, Tokyo (JP); Takashi Mochizuki, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 15/756,457

(22) PCT Filed: Sep. 9, 2016

(86) PCT No.: PCT/IB2016/055370

§ 371 (c)(1),
(2) Date: Feb. 28, 2018

(87) PCT Pub. No.: WO2017/042718

PCT Pub. Date: Mar. 16, 2017

(65) Prior Publication Data

US 2018/0245805 A1 Aug. 30, 2018

(30) Foreign Application Priority Data

Sep. 11, 2015 (JP) ..... 2015-179041

(51) Int. Cl.
*F24F 1/22* (2011.01)
*F24F 1/56* (2011.01)

(52) U.S. Cl.
CPC . *F24F 1/56* (2013.01); *F24F 1/22* (2013.01)

(58) Field of Classification Search
CPC ..... F24F 1/10; F24F 1/08; F24F 1/26; F24F 1/16; F24F 1/50; F24F 2013/202; F24F 1/56
See application file for complete search history.

(56) References Cited

U.S. PATENT DOCUMENTS

2014/0338384 A1* 11/2014 Koike ..... F24F 13/222 62/285
2015/0043133 A1* 2/2015 Yanase ..... F24F 1/56 361/627

FOREIGN PATENT DOCUMENTS

CN 1782561 A 6/2006
CN 1847735 A 10/2006
(Continued)

OTHER PUBLICATIONS

International Search Report of PCT/IB2016/055370 dated Feb. 9, 2017.

*Primary Examiner* — Elizabeth J Martin
(74) *Attorney, Agent, or Firm* — Mattingly & Malur, PC

(57) ABSTRACT

An outdoor unit (100, 110), comprising a housing (1, 20) having fans (2) provided thereon and a compressor (4) and heat exchanger (3-1, 3-2, 23-1, 23-2) disposed on a base (10, 210) thereof; a left-right pair of side covers (8, 28, 9, 29) each being bent and having two surfaces, one surface covering a portion of a side of housing (1, 20), and the other surface covering a portion of the front of the housing (1, 20); a controller housing (7) fixed to the upper section of the surface of at least one side cover (8, 28, 9, 29), of said left-right pair of said covers (8, 28, 9, 29), that covers a portion of the front of the housing (1, 20), said controller housing (7) being fixed at a height allowing the compressor (4) to be moved into and out of the housing unobstructed.

6 Claims, 4 Drawing Sheets

A-A arrow view

(56) References Cited

FOREIGN PATENT DOCUMENTS

| | | | |
|---|---|---|---|
| CN | 201448934 | U | 5/2010 |
| JP | 5380503 | B2 | 1/2014 |

* cited by examiner

OUTDOOR UNIT

TECHNICAL FIELD

The present invention relates to an outdoor unit of an air conditioner, a refrigerator and so forth and, in particular, relates to the outdoor unit of the air conditioner or the refrigerator by which it becomes possible to promote compactification, cost reduction and so forth.

BACKGROUND ART

An air conditioner which cools and heats an office, a factory and so forth is equipped with an indoor unit which is installed indoors and an outdoor unit which is installed outdoors. The outdoor unit makes a refrigerant which passes through refrigerant piping and outdoor air exchange heat by a heat exchanger provided in a housing, evaporates or condenses the refrigerant and thereafter supplies the refrigerant to the indoor unit. The indoor unit cools or heats indoor air by utilizing latent heat of the refrigerant supplied from the outdoor unit.

In a case where a comparatively large air-conditioning capacity is requested as in an air conditioner for building, a so-called modular-type form that one refrigerant system is configured by connecting a plurality of the outdoor units with one another has become mainstream in recent years.

In a case of the modular-type one like this, since the outdoor unit is configured by continuously installing the plurality of outdoor units, there is such an issue that the total installation area of the outdoor units which are continuously installed is increased. Therefore, there are cases where a configuration is made in such a manner that a height of the heat exchanger is made large or the heat exchanger extends not only to a back face of a housing but also up to side faces and a front face of the housing in order to secure a necessary heat exchanger capacity while suppressing the installation area of the single-body outdoor unit.

Incidentally, as related art of this kind, there is the one described in Patent Literature 1 and so forth.

CITATION LIST

Patent Literature

Patent Literature 1: Japanese Patent No. 5380503

SUMMARY OF INVENTION

Technical Problem

In the one according to the related art described in Patent Literature 1 and so forth, the heat exchanger is made to extend from the back face to the side faces of the housing and thereby it is possible to secure the predetermined heat transfer area without increasing the height dimension of the outdoor unit. However, in such a case, it is necessary to provide a large opening in the housing which covers the side faces in order to expose the heat exchanger because the heat exchanger is made to extend up to the side faces of the housing. Consequently, there is such an issue that the area of a sheet metal member which supports the side faces of the housing is reduced and strength of the housing is lowered.

An object of the present invention is to obtain an outdoor unit of an air conditioner or a refrigerator which makes maintenance of the strength of the housing and installation with the saved installation area possible after securing a necessary heat exchange performance by making the heat exchanger extend to the whole areas of the back face and both of the side faces of the housing.

Solution to Problem

In order to solve the above-described issue, in the present invention, in an outdoor unit of an air conditioner or a refrigerator, this outdoor unit is configured by including a housing with a fan being mounted and with a compressor and a heat exchanger being loaded on a bottom base, a controller housing in which a controller which controls the fan and the compressor is built and one pair of left and right side covers which have two faces formed by being bent and cover parts of side faces of the housing with one faces and cover parts of the front of the housing with the other faces and is configured in such a manner that the controller housing is fixed to a position of a height at which the controller housing does not become an obstacle when the compressor is put out of and into the inside of the housing, on an upper part of a face of at least one side cover which covers the part of the front of the housing in one pair of the left and right side covers.

In addition, in order to solve the above-described issue, in the present invention, in an outdoor unit of air conditioner or refrigerator, this outdoor unit is configured by including a fan which sucks and expels air, a heat exchanger, a compressor which compresses a refrigerant, a controller housing in which a controller which controls the fan or the compressor is built and a housing section which houses therein the heat exchanger, the compressor and the controller housing and to an upper face of which the fan is attached and is configured in such a manner that the housing section is equipped with one pair of left and right side covers which have two faces formed by being bent and which cover parts of side faces of the housing with one faces and cover parts of the front of the housing with the other faces and a maintenance panel which is detachably attached to parts of one pair of the left and right side covers which cover the parts of the front of the housing section and the controller housing is fixed with a fixing member to a position of a height at which the controller housing does not become an obstacle when the compressor is put out of and into the inside of the housing section, on the inner side of the maintenance panel on a face of at least one side cover which covers the part of the front of the housing section in one pair of the left and right side covers.

Advantageous Effects of Invention

According to the present invention, the controller housing also serves to reinforce the housing of the outdoor unit and thereby it becomes possible to compensate for strength poverty of the cover of the housing without using an extra reinforcement member. In addition, since the controller housing is disposed above the housing and on the front of the housing of the outdoor unit, a thing which would become an obstacle when the compressor is put out of and into the housing of the outdoor unit from the front face thereof is not present and thereby it becomes possible to perform attachment and detachment of the compressor with ease.

DESCRIPTION OF EMBODIMENTS

The present invention is configured in such a manner that, in an outdoor unit of an air conditioner or a refrigerator, a controller housing of the outdoor unit is fixed to upper parts of side covers which cover side faces and parts of the front of a housing of the outdoor unit so as to reinforce bending strength and torsional strength of the housing of the outdoor unit and to eliminate a thing which would become an obstacle when a compressor is put out of and into a front face of the housing of the outdoor unit and thereby assemblability and maintainability of the outdoor unit are improved.

In all drawings for describing the present embodiments, the same symbols are assigned to things having the same functions and repetitive description thereof is omitted in principle. In the following, embodiments of the present invention will be described in detail on the basis of the drawings.

However, the present invention shall not be interpreted by limiting to contents described in the following embodiments. A person skilled in the art would readily understand that a specific configuration thereof may be modified and altered within a range not deviating from the idea and the gist of the present invention.

First Embodiment

Embodiments of the present invention will be described by giving an outdoor unit of an air conditioner by way of example.

Figure 1:
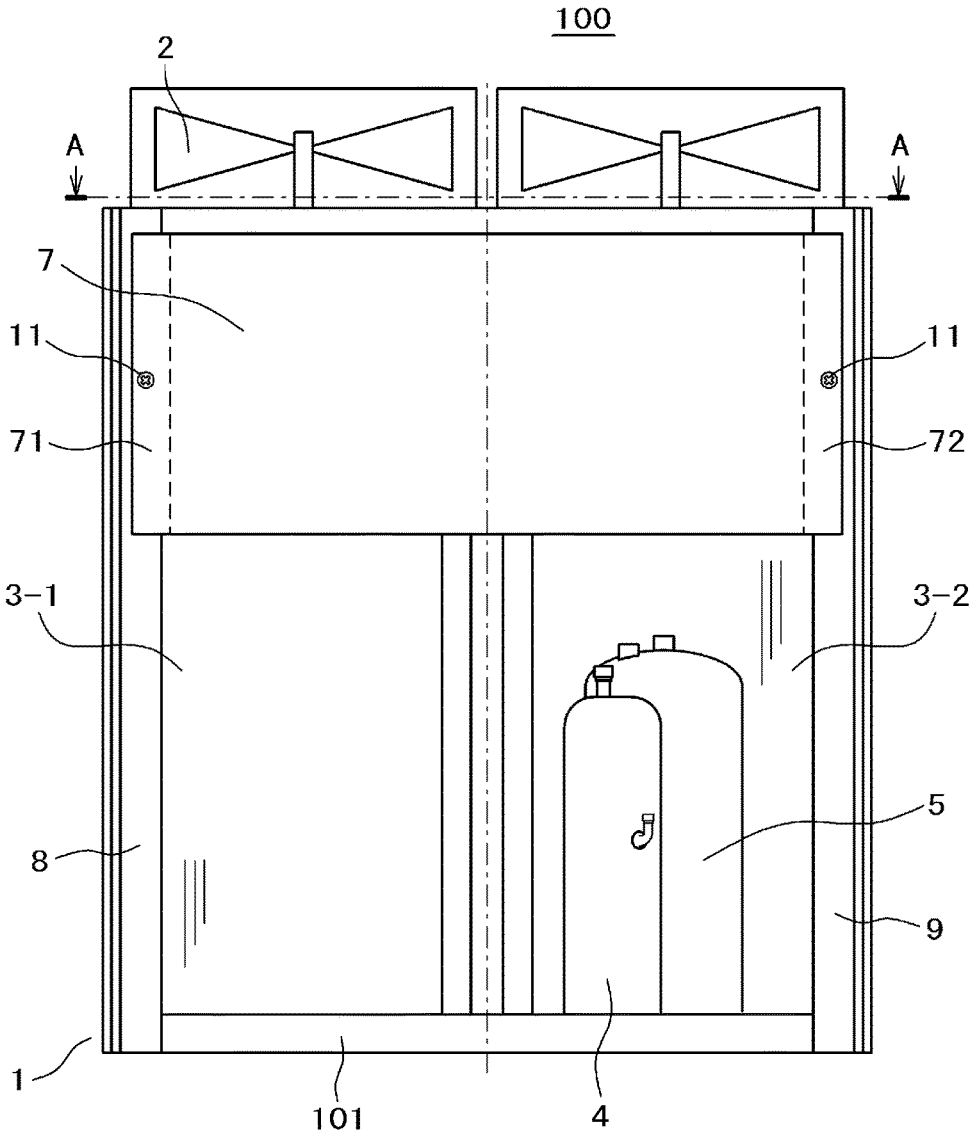
FIG. 1 is a front view of an air conditioning outdoor unit according to a first embodiment of the present invention.
Figure 2:
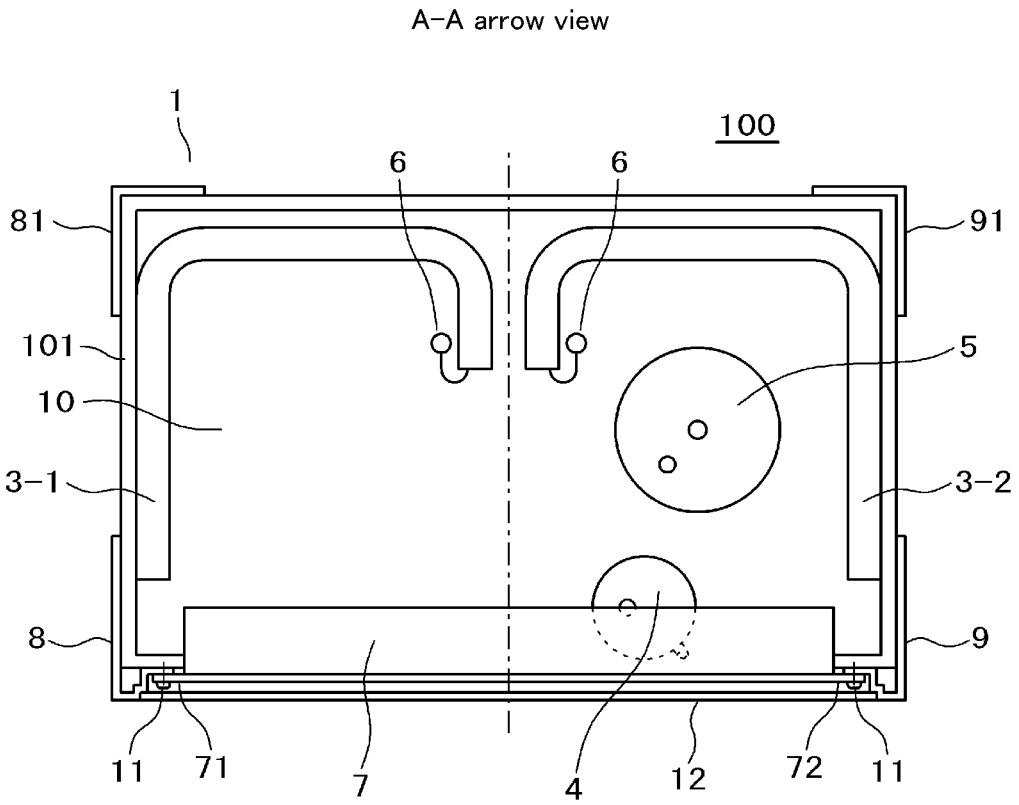
FIG. 2 is a sectional diagram of the air conditioning outdoor unit according to the first embodiment of the present invention along the A-A line in FIG. 1.

FIG. 1 is a front sectional diagram of an outdoor unit 100 of an air conditioner 1000 according to a first embodiment and FIG. 2 is a sectional diagram along the A-A line in FIG. 1.

In FIG. 1 and FIG. 2, 1 is a housing of the outdoor unit 100 of the air conditioner, 2 is a fan which performs air-sucking into and air-expelling out of the housing 1, 3-1 and 3-2 are heat exchangers respectively, 4 is a compressor, 5 is an accumulator, 6 is a header pipe and 7 is a controller housing and control circuit components are housed therein. 8 is a housing left cover which covers left-side front face and side face of the housing 1, 81 is a housing left rear cover which covers the left rear side of the housing 1, 9 is a housing right cover which convers right-side front face and side face of the housing 1, 91 is a housing right rear cover of the right rear side of the housing 1, 10 is a baseplate onto which the compressor 4 and the accumulator 5 are loaded and fixed, 11 is a fixture, and 12 is a maintenance panel which covers the front face of the housing and is detachably attached to the housing 1.

The baseplate 10 is, an end part of a circumference is bent upward and thereby an edge part 101 is formed. Although various kinds of piping and electric wiring are stretched in the housing 1, illustration thereof is omitted for simplification of illustration.

The housing left cover 8, the housing left rear cover 81, the housing right cover 9 and the housing right rear cover 91 are each fastened to the edge part 101 which is bent to the upper side of the end part of the baseplate 10 with a screw or a bolt in the vicinity of a lower end part thereof and the vicinity of an upper end part of each of them is fastened with a screw or a bolt and fixed to a top plate which is not illustrated and is attached to an upper face of the housing 1.

In FIG. 1, two fans 2 are arranged above the housing 1 of the air conditioning outdoor unit, side by side on the left and the right viewing from the housing front and are provided so as to expel air upward.

Containers such as the compressor 4 and the accumulator 5 are loaded in the housing 1 and further they are fixed to the baseplate 10 of the housing 1. In addition, although not illustrated in the drawings, they are connected with a four-way valve adapted to change a flowing direction of a refrigerant which flows in the heat exchangers 3-1 and 3-2, the header pipes 6 (see FIG. 2) provided on end parts of the heat exchangers 3-1 and 3-2 and so forth by not illustrated refrigerant piping thereby to form a refrigerating cycle.

In FIG. 1, the housing left cover 8 and the housing right cover 9 are provided on the front left side and right side of the housing 1 respectively. As illustrated in FIG. 2, the housing left cover 8 and the housing right cover 9 have faces which face the front side of the housing 1 (a lower-side face of the housing 1 illustrated in FIG. 2) and faces which face the side-face sides thereof (the right-side or left-side face of the housing 1 illustrated in FIG. 2). Parts of the faces of the housing left cover 8 and the housing right cover 9 which face the front side of the housing 1 are shaped into stepped-forms of two steps. Although not illustrated in the drawings, the housing left cover 8 and the housing right cover 9, and the housing left rear cover 81 and the housing right rear cover 91 play parts of supporting heavy goods which are disposed above the housing 1 such as fan motors which rotate the fans, clamps which support the fan motors and shrouds which surround the fans.

In addition, in FIG. 1 and FIG. 2, the controller housing 7 which builds therein a control circuit part adapted to drive the compressor 4 and the fan motors is disposed above the housing 1 so as to run along the front thereof. The controller housing 7 is configured by a sheet metal member which houses therein electric components such as a circuit board and a terminal block of the not illustrated control circuit part and therefore is the heavy good. Also this controller housing 7 is held by the aforementioned housing left cover 8 and housing right cover 9.

In addition, in FIG. 2, the two almost U-shaped heat exchangers 3-1 and 3-2 are arranged side by side on the left and the right viewing from the front of the housing 1 similarly to the fans 2 and are provided so as to surround the left and right fans 2 respectively. Incidentally, these heat exchangers 3-1 and 3-2 are provided along the side faces of the housing 1 except the front thereof on the left and the right respectively. In addition, bent lengths of the respective left and right heat exchangers 3-1 and 3-2 are configured to be longer on the housing side-face sides (the right-side face side and the left-side face side of the housing 1 in FIG. 2) and to be shorter on the housing inner sides (the sides on which they are connected with the header pipes 6).

It is possible to secure the necessary volumes of the heat exchangers 3-1 and 3-2 without expanding the installation area of the housing 1 by disposing the heat exchangers 3-1 and 3-2 along the back face and both of the left and right side faces of the housing 1 in this way. However, since the heat exchangers 3-1 and 3-2 serve as air suction ports of the fans 2, it is necessary to form it into such a structure that it is possible to take the outdoor air into the housing 1 via the heat exchangers 3-1 and 3-2. Accordingly, it is formed into a structure that spaces are left between the housing left cover 8 and the housing left rear cover 81 and between the housing right cover 9 and the housing right rear cover 91 so as to attach them therebetween respectively. Therefore, the strength of the housing 1 is lowered in comparison with a case where the surrounding thereof is covered with a full cover.

In addition, to put the compressor 4 out of and into inside of the housing 2, it is not possible to dispose a thing on the front face of the housing 1 (the lower-side face of the housing 1 in FIG. 2) which would become an obstacle when the compressor 4 is put out of and into inside of the housing 1. Accordingly, there is no reinforcement on the front face of the housing 1 when left as it is and the housing 1 is formed into a structure which is fragile against bending and torsion.

Therefore, in the first embodiment, it is formed into a configuration that end parts 71 and 72 are formed on the both sides of the controller housing 7, and the end parts 71 and 72 on the both sides are fastened to a part of the housing left cover 8 which is bent to the front-face side of the housing 1 and a part of the housing right cover 9 which is bent to the front-face side of the housing 1 with at least one fixture 11 each. As the fixture 11, for example, the one that a bolt is combined with a nut may be used.

The controller housing 7 is formed into a box shape as illustrated in FIG. 2, is large in rigidity in comparison with a case of a one-sheet plate and is difficult to deform even when force of bending and torsion is imposed. It is possible to compensate for the poverty of strength of the housing left cover 8 and the housing right cover 9 against bending and torsion by configuring to fix the end parts 71 and 72 on the both sides of the controller housing 7 to the faces of the housing left cover 8 and the housing right cover 9 which are bent to the front-face side of the housing 1 respectively in this way.

The parts of the faces of the housing left cover 8 and the housing right cover 9 which face the front side of the housing 1 are shaped into the stepped forms of the two steps. They are made in such a manner that the maintenance panel 12 is attached to the first step of this stepped form part with a not illustrated fixture and the controller housing 7 is attached to the second step of the stepped form part thereby to normally cover the front face with the maintenance panel 12 so as not to expose the controller housing 7 directly to the outdoor air. Incidentally, the maintenance panel 12 is detachably attached to the housing left cover 8 and the housing right cover 9 with the bolts or the screws.

A state where the maintenance panel 12 which covers the front face of the housing 1 is removed is illustrated in FIG. 1. Although in the configuration illustrated in FIG. 1, an example that the end part 71 of the controller housing 7 is fixed to the housing left cover 8 with one fixture 11 is illustrated, in the present embodiment, they may be fixed to the housing left cover 8 and the housing right cover 9 respectively by using the plurality of fixtures 11, not limited to this.

In addition, the controller housing 7 also serves to reinforce the housing 1 and thereby it is possible to compensate for the strength poverty of the housing left cover 8 and the housing right cover 9 without using the extra reinforcement member.

Further, since the controller housing 7 is disposed upper part of the housing 1 and on the front of the housing 1, there is no thing which would become the obstacle when the compressor 4 is put out of and into the housing 1 from the front (the front face) thereof and it is possible to perform attachment and detachment of the compressor 4 with ease. Further, since it is excellent in maintainability and it is possible to dispose the compressor 4 on the center and on the front face of the housing 1, it is excellent in exchangeability in failure of the compressor 4 and the center of gravity of the whole housing 1 is well-balanced.

Second Embodiment

Figure 3:
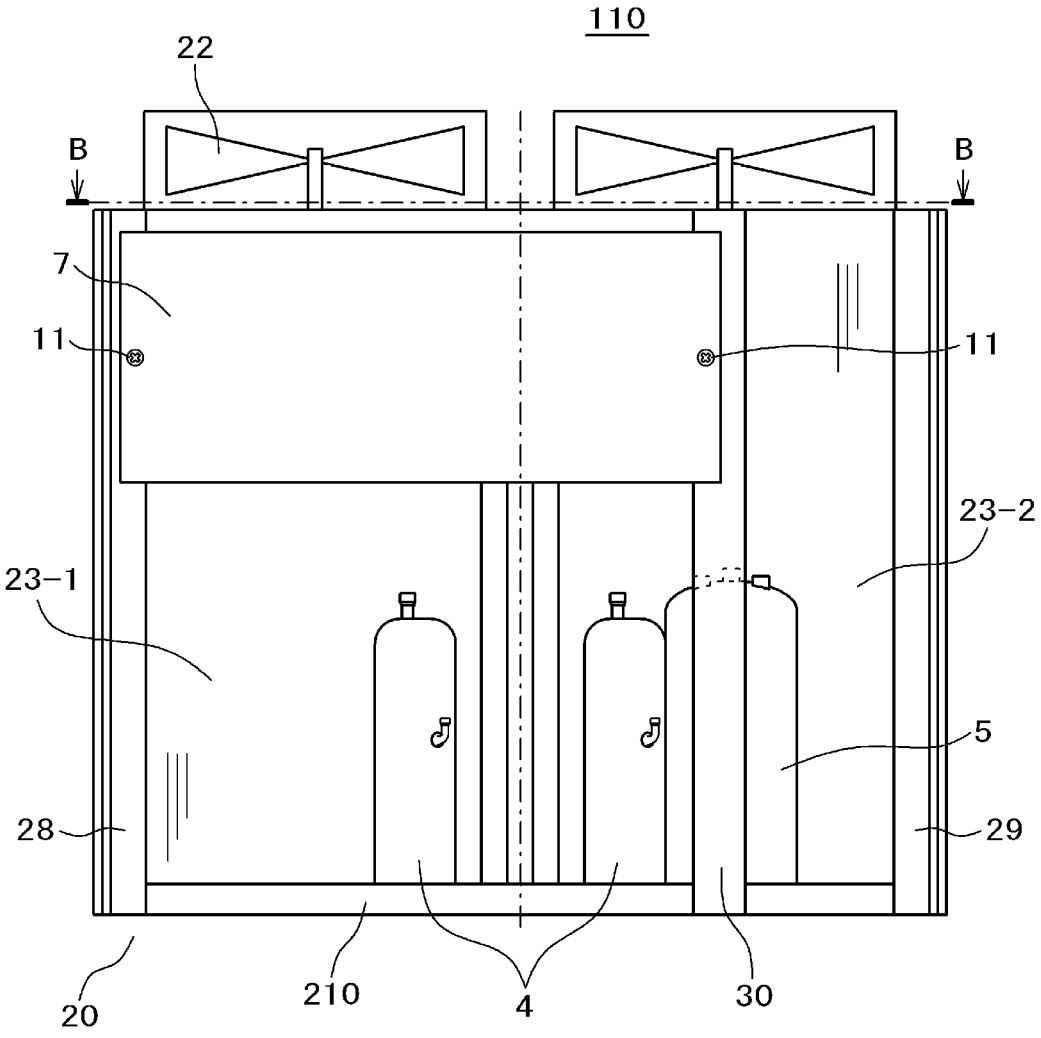
FIG. 3 is a front view of an air conditioning outdoor unit according to a second embodiment of the present invention.
Figure 4:
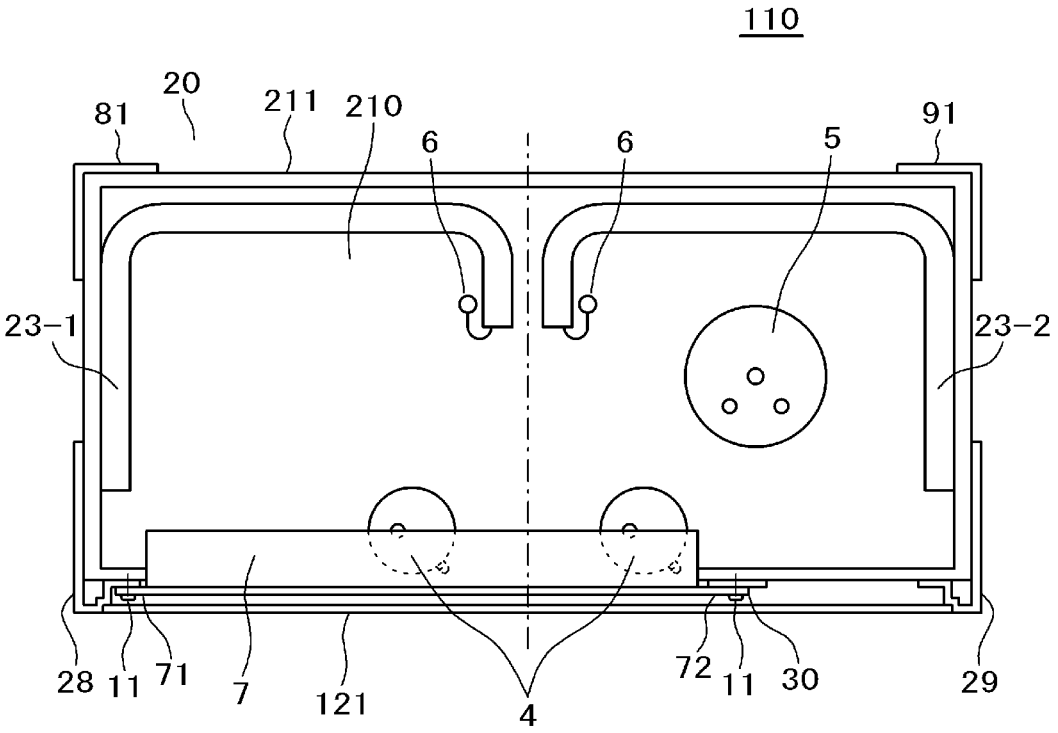
FIG. 4 is a sectional diagram of the air conditioning outdoor unit according to the second embodiment of the present invention along the B-B line in FIG. 3.

FIG. 3 is a front sectional diagram of an outdoor unit 110 according to a second embodiment and FIG. 4 is a sectional diagram along the B-B line in FIG. 3. In the respective drawings, parts to which the same symbols are assigned indicate the same parts.

The outdoor unit 110 according to the second embodiment indicates the outdoor unit 110 in a case where the cooling and heating capacity which is larger than that of the outdoor unit 100 according to the first embodiment is requested. Although the basic configuration thereof is similar to that of the outdoor unit 100 according to the first embodiment, the heat transfer areas of heat exchangers 23-1 and 23-2 are increased by expanding a baseplate 210 and increasing a width of a housing 20.

Since heavy goods such as fans 22 which are provided above the housing 20 and not illustrated fan motors and shrouds become heavier in comparison with those of the first embodiment, additional strength is necessary for a housing left cover 28 and a housing right cover 29, the housing left rear cover 81, the housing right area cover 91 and so forth to be fixed to an edge part 211 of the baseplate 210 and a not illustrated top plate. However, it is difficult to thicken sheet thicknesses of components such as the housing left cover 28 and the housing right cover 29, the housing left rear cover 81, the housing right rear cover 91 and so forth in cost, and in addition, it is desirable that sharing of the housing left cover 8 and the housing right cover 9, the housing left rear cover 28, the housing right rear cover 29 and so forth used in the first embodiment be possible.

Therefore, in the second embodiment, a stationary plate 30 is provided on the front of the housing 20 and on the right side from the width center of the housing 20 so as to compensate for the strength poverty of the housing left cover 28 and the housing right cover 29. Further, the controller housing 7 is formed into a structure that the left-side end part 71 of the controller housing 7 is fastened to the housing left cover 28 and the right-side end part 72 of the controller housing 7 is fastened to the stationary plate 30 with at least one fixture 11 similarly to the first embodiment. It is possible to complement for the strength of each of them by configuring in this way.

In addition, also in a case where the two or more compressors 4 are to be loaded in order to exhibit the larger cooling and heating capacity, since it is possible to install them on the front and the center of the housing 1 as illustrated in FIG. 3 and FIG. 4, it is excellent in exchangeability in failure of the compressor 4 and the center of gravity of the whole housing 1 is well-balanced. A maintenance panel 121 is attached to the front face of the housing 2 to which the controller housing 7 is attached so as to cover the front face of the housing 20 including the controller housing 7.

Incidentally, although the examples of the outdoor units of the air conditioner are described in the above-described first embodiment and second embodiment, the present invention is not limited to them and is also applicable to the outdoor unit of the refrigerator.

REFERENCE SIGNS LIST

1, 20 . . . housing, 2 . . . fan, 3-1, 3-2, 23-1, 23-2 . . . heat exchanger, 4 . . . compressor, 5 . . . accumulator, 6 . . . header pipe, 7 . . . controller housing, 71, 72 . . . controller housing end part, 8, 28 . . . housing left cover, 81 . . . housing left rear cover, 9, 29 . . . housing right cover, 91 . . . housing right rear cover, 10, 210 . . . baseplate, 11 . . . fixture, 12, 121 . . . maintenance panel, 30 . . . stationary plate, 100, 110 . . . outdoor unit.

The invention claimed is:

1. An outdoor unit of an air conditioner or a refrigerator comprising:

a housing with a fan being mounted and with a compressor and a heat exchanger being loaded on a bottom base;

a controller housing in which a controller which controls the fan and the compressor is disposed; and a left cover having a first face and a second face intersecting each other at a bend in the left cover, the first face covering a portion of a left side face of the housing and the second face covering a portion of a front face of the housing;

a right cover having a first face and a second face intersecting each other at a bend in the right cover, the first face covering a portion of a right side face of the housing and the second face covering a portion of the front face of the housing, wherein, the controller housing is fixed to a position of the housing at a height at which the controller housing is not an obstacle when the compressor is removed out of and into an inside of the housing, and is fixed on an upper part of at least one of the second face of the left cover and the second face of the right cover, and wherein the heat exchanger is disposed along a back face of the housing and along a portion of both the left and right sides of the housing, and is not disposed along the front face of the housing.

2. The outdoor unit according to claim 1, wherein the controller housing is fixed to the position of the housing at the height at which the controller housing is not the obstacle when the compressor is removed out of and into the inside of the housing, on upper parts of both the second face of the left cover and the second face of the right cover.

3. The outdoor unit according to claim 1, wherein the controller housing is fixed to a stationary plate which is attached to the front side face of the housing between the right cover and the left cover.

4. An outdoor unit of an air conditioner or a refrigerator having:

a fan which sucks and expels air;

a heat exchanger;

a compressor which compresses a refrigerant;

a controller housing in which a controller which controls the fan or the compressor is disposed; and a housing section which houses therein the heat exchanger, the compressor and the controller housing, the fan being attached to an upper face of the housing section, wherein the housing section is equipped with a left cover having a first face and a second face intersecting each other at a bend in the left cover, the first face covering a portion of a left side face of the housing and the second face covering a portion of a front face of the housing, a right cover having a first face and a second face intersecting each other at a bend in the right cover, the first face covering a portion of a right side face of the housing and the second face covering a portion of the front face of the housing, and a maintenance panel which is detachably attached to respective portions of the second face of the left cover and the second face of the right cover, wherein the controller housing is fixed to an inner side of the maintenance panel and the controller is attached on at least one of the second face of the left cover and the second face of the right cover, and to a position of the housing at a height at which the controller housing is not an obstacle when the compressor is removed out of and into an inside of the housing section with a fixing member, and wherein the heat exchanger is disposed along a back face of the housing section and along a portion of both the left and right sides of the housing section, and is not disposed along the front face of the housing section.

5. The outdoor unit according to claim 4, wherein the controller housing is fixed to upper parts of both the second face of the left cover and the second face of the right cover, and at the position at the height at which the controller housing is not the obstacle when the compressor is removed out of and into the inside of the housing section.

6. The outdoor unit according to claim 4, wherein the controller housing is fixed to a stationary plate which is attached to a front face of the housing between the right cover and the left cover.

* * * * *